US009217622B2

(12) United States Patent
Mooy et al.

(10) Patent No.: US 9,217,622 B2
(45) Date of Patent: Dec. 22, 2015

(54) 5XXX ALUMINUM ALLOYS AND WROUGHT ALUMINUM ALLOY PRODUCTS MADE THEREFROM

(75) Inventors: Dirk C. Mooy, Bettendorf, IA (US); Roberto J. Rioja, Murrysville, PA (US); Ralph R. Sawtell, Gibsonia, PA (US); Francine S. Bovard, Monroeville, PA (US); Gregory B. Venema, Bettendorf, IA (US); David A. Linde, Bettendorf, IA (US)

(73) Assignee: Alcoa Inc., Pittsburgh, PA (US)

( * ) Notice: Subject to any disclaimer, the term of this patent is extended or adjusted under 35 U.S.C. 154(b) by 566 days.

(21) Appl. No.: 12/842,940

(22) Filed: Jul. 23, 2010

(65) Prior Publication Data

US 2011/0017055 A1 Jan. 27, 2011

Related U.S. Application Data

(60) Provisional application No. 61/228,452, filed on Jul. 24, 2009.

(51) Int. Cl.

| | |
|---|---|
| ***F41H 5/02*** | (2006.01) |
| ***C22C 21/06*** | (2006.01) |
| ***F41H 5/04*** | (2006.01) |
| ***C22F 1/047*** | (2006.01) |

(52) U.S. Cl.

CPC ..... *F41H 5/0442* (2013.01); *C22C 21/06* (2013.01); *C22F 1/047* (2013.01)

(58) Field of Classification Search

USPC ..... 148/439; 420/533
IPC ..... C22C 21/06; F41H 5/0442
See application file for complete search history.

(56) References Cited

U.S. PATENT DOCUMENTS

| | | | | |
|---|---|---|---|---|
| 3,135,633 | A | 6/1964 | Hornus | 148/695 |
| 3,645,804 | A | 2/1972 | Ponchel | 148/502 |
| 3,945,860 | A | 3/1976 | Winter et al. | 148/502 |
| 4,715,901 | A | 12/1987 | Granger | 428/472.2 |
| 5,240,522 | A | 8/1993 | Tanaka et al. | 148/693 |
| 5,554,428 | A | 9/1996 | Bartges et al. | 428/64.1 |
| 5,620,652 | A | 4/1997 | Tack et al. | 420/532 |
| 5,624,632 | A | 4/1997 | Baumann et al. | 420/544 |

(Continued)

FOREIGN PATENT DOCUMENTS

| | | | |
|---|---|---|---|
| JP | 05179389 A | * | 7/1993 |
| RU | 2280705 | | 2/2006 |

(Continued)

OTHER PUBLICATIONS

Cheeseman, B., et al., "Ballistic Evaluation of Aluminum 2139-T8," 24th *International Ballistics Symposium*, New Orleans, LA, Sep. 22-26, 2008.

(Continued)

*Primary Examiner* — George Wyszomierski
*Assistant Examiner* — Janelle Morillo
(74) *Attorney, Agent, or Firm* — Greenberg Traurig, LLP

(57) ABSTRACT

Improved 5xxx aluminum alloys and products made therefrom are disclosed. The new 5xxx aluminum alloy products may achieve an improved combination of properties due to, for example, the presence of copper. In one embodiment, the new 5xxx aluminum alloy products are able to achieve an improved combination of properties by solution heat treatment.

19 Claims, 3 Drawing Sheets

(56) References Cited

U.S. PATENT DOCUMENTS

| | | | | |
|---|---|---|---|---|
| 6,117,252 | A | 9/2000 | Barlat et al. | 148/439 |
| 6,139,653 | A * | 10/2000 | Fernandes et al. | 148/439 |
| 6,238,495 | B1 | 5/2001 | Haszler et al. | 148/440 |
| 6,258,318 | B1 | 7/2001 | Lenczowski | 420/542 |
| 6,342,112 | B1 | 1/2002 | Barlat et al. | 148/439 |
| 6,342,113 | B2 | 1/2002 | Haszler et al. | 148/440 |
| 6,544,358 | B1 | 4/2003 | Carr et al. | 148/440 |
| 6,562,154 | B1 | 5/2003 | Rioja et al. | 148/415 |
| 6,630,039 | B2 | 10/2003 | Lukasak et al. | 148/690 |
| 2004/0003872 | A1 * | 1/2004 | Pillet et al. | 148/440 |
| 2004/0089379 | A1 | 5/2004 | Mahon | 148/552 |
| 2004/0109787 | A1 * | 6/2004 | Haszler et al. | 420/542 |
| 2007/0246137 | A1 | 10/2007 | Lequeu et al. | 148/693 |
| 2008/0056931 | A1 | 3/2008 | Connor et al. | 420/532 |
| 2008/0257462 | A1 * | 10/2008 | Ichitani et al. | 148/694 |

FOREIGN PATENT DOCUMENTS

| | | |
|---|---|---|
| WO | WO2007/020041 | 2/2007 |
| WO | WO 2008098743 A1 * | 8/2008 |

OTHER PUBLICATIONS

Chinella, J. F., "High-Strength Al—Cu—Li and Al—Zn Alloys: Mechanical Properties with Statistical Analysis of Ballistic Performance," Pub. No. ARL-TR-3185, pp. 1-61, U.S. Army Research Laboratory, Apr. 2004.

Fridlyander, J., *Advanced Russian Aluminum Alloys*, Aluminum alloys: Their Physical and Mechanical Properties, Proceeding ICAA4 vol. II, pp. 80-87, Sep. 11-16, 1994.

Gooch, W. A., et al., "Ballistic Testing of Commercial Aluminum Alloys and Alternate Processing Techniques to Increase the Availability of Aluminum Armor," 23rd International Symposium on Ballistics, Tarragona, Spain, Apr. 16-22, 2007.

Gooch, W. A., et al., "Analysis of Threat Projectiles for Protection of Light Tactical Vehicles," Report No. ARL-RP-89, Army Research Laboratory, 2004.

Hatch, J. E., et al. *Aluminum: Properties and Physical Metallurgy*, American Society for Metals, pp. 47-48, 50-52, 58-60, 64, 66-67, 356-357 (1984).

Teleshov, V. V., et al., *Influence of Chemical Composition on High- and Low-Cycle Fatigue with Zero-Start Extension of Sheets of D16 and V95 Alloys*, pp. 141-144, Russian Metallurgica, Moscow, 1983.

*Aluminum and Aluminum Alloys*, ASM Specialty Handbook, ASM International, pp. 18-22, 24, 28-30, 672-683 (1993).

Registration Record Series Teal Sheets, *International Alloy Designations and Chemical Composition Limits for Wrought Aluminum and Wrought Aluminum Alloys*, The Aluminum Association, pp. 1-27, Feb. 2009.

Publication No. ANSI H35.1, "American National Standard Alloy and Temper Designation Systems for Aluminum," pp. 1-11, The Aluminum Association Inc., 2009.

Publication No. MIL-A-46063G, "Armor Plate, Aluminum Alloy, 7039," pp. 1-26, U.S. Army Materials Technology Laboratory, Dec. 1992.

Publication No. MIL-DTL-46027K(MR), "Armor Plate, Aluminum Alloy, Weldable 5083, 5456, & 5059," pp. 1-28, U.S. Army Research Laboratory, Jul. 2007.

Publication No. MIL-DTL-46192C(MR), Amendment 1, "Aluminum Alloy Armor Rolled Plate (1/2 to 4 Inches Thick), Weldable (Alloy 2519)," pp. 1-21 and Appendix A, U.S. Army Research Laboratory, Feb. 2000.

Rinnovatore, J. V., et al., "Correlation Determinations Between Stress Corrosion Characteristics of Wrought 7039 Aluminum Armor and Other Alloy Characteristics—Ballistic Performance, Yield Strength, and Electrical Conductivity," pp. 1-26, Frankford Arsenal Technical Report FA-TR-75026, Apr. 1975.

Vruggink, J. E., "Study of Improved Aluminum Materials for Vehicular Armor," pp. 1-172, Frankford Arsenal Technical Report No. FA-54-76073, Defense Technical Information Center, Accession No. ADA039488, Apr. 1977.

Carroll, M.C., et al., "Effects of minor Cu additions on a Zn-modified Al-5083 alloy", *Materials Science and Engineering A319-321*, pp. 425-428 (2001).

* cited by examiner

5XXX ALUMINUM ALLOYS AND WROUGHT ALUMINUM ALLOY PRODUCTS MADE THEREFROM

CROSS-REFERENCE TO RELATED APPLICATION

This patent application claims priority to U.S. Provisional Patent Application No. 61/228,452, entitled "IMPROVED 5XXX ALLOYS" filed Jul. 24, 2009, which is incorporated herein by reference in its entirety.

BACKGROUND

Wrought aluminum alloys are generally classified by series. There are currently eight different wrought alloy series, which are commonly referred to as 1 xxx-8xxx. The 1 xxx series aluminum alloys contain at least about 99.00 wt. % aluminum per Aluminum Association standards. The 2xxx-7xxx aluminum alloys do not have the same Al restriction, and are classified according to their main alloying element(s). The 2xxx aluminum alloys use copper, the 3xxx aluminum alloys use manganese, the 4xxx aluminum alloys use silicon, the 5xxx aluminum alloys use magnesium, the 6xxx aluminum alloys use magnesium and silicon, and the 7xxx aluminum alloys use zinc as their main alloying ingredient.

The 2xxx-7xxx are also generally split into two different categories: heat treatable and non-heat treatable. The non-heat treatable alloys are the 3xxx, 4xxx, and 5xxx aluminum alloys, whereas the heat treatable alloys are the 2xxx, 6xxx and 7xxx aluminum alloys. The 3xxx, 4xxx, and 5xxx aluminum alloys are classified as non-heat treatable because they cannot generally be appreciably strengthened by solution heat treatment. Instead, the 3xxx, 4xxx, and 5xxx aluminum alloys are usually strengthened by solid-solution, formation of second-phase microstructural constituents, dispersoid precipitates and/or strain hardening. Conversely, the 2xxx, 6xxx, and 7xxx aluminum alloys are considered heat treatable because they undergo significant strengthening when subjected to solution heat treatment and aging. The most prominent systems are Al—Cu—Mg, Al—Cu—Si, and Al—Cu—Mg—Si (all 2xxx aluminum alloys), Al—Mg—Si (a 6xxx aluminum alloy) and Al—Zn—Mg and Al—Zn—Mg—Cu (all 7xxx aluminum alloys).

High strength aluminum alloys, such as 5xxx series aluminum alloys (i.e., aluminum alloys containing magnesium as its main alloying ingredient), may be employed in various industries, such as in the military. However, it is difficult to improve the performance of one property of a 5xxx aluminum alloy (e.g., strength) without decreasing the performance of a related property (e.g., corrosion resistance).

SUMMARY OF THE DISCLOSURE

Broadly, the present disclosure relates to improved 5xxx series aluminum alloys having an improved combination of properties. Products made from the new 5xxx aluminum alloys may achieve an improved combination of at least two of strength, toughness, ductility, corrosion resistance, formability, surface appearance, fatigue, ballistics performance and weldability, among others. For example, the new 5xxx aluminum alloy products may achieve improved strength while maintaining corrosion resistance relative to comparable prior art alloys. The new 5xxx aluminum alloy products may achieve an improved combination of properties due to, for example, the presence of copper. In one embodiment, the new 5xxx aluminum alloy products are able to achieve an improved combination of properties by solution heat treatment, i.e., by placing at least some of the Cu in solid solution with the aluminum, sometimes called solutionizing. In contradistinction to the conventional wisdom, solutionizing a 5xxx aluminum alloy with copper facilitates production of 5xxx aluminum alloy products having an improved combination of properties, as described in further detail below.

The new 5xxx series aluminum alloy products are generally ingot cast (e.g., direct chill cast), wrought aluminum alloy products (e.g., rolled sheet or plate, extrusions, or forgings). The new 5xxx aluminum alloy products generally include 2-7 wt. % Mg and 0.05-2 wt. % Cu. The new 5xxx aluminum alloy products generally comprises (and in some instances consists essentially of) magnesium and copper, optionally with Zn, optionally with additives, the balance being aluminum and unavoidable impurities. Generally, the amount of Mg, Cu, optional Zn, optional additives, and unavoidable impurities employed in the alloy should not exceed their solubility limit. Some non-limiting examples of new 5xxx aluminum alloys are illustrated in Table 1, below.

TABLE 1

Examples of New 5xxx Series Aluminum Alloys

| | Mg | Cu | Zn (optional) | Additives (optional) | Al |
|---|---|---|---|---|---|
| Alloy A | 2-7 | 0.05-2.0 | up to 2.0 wt. % | up to 2.5 wt. % | Balance |
| Alloy B | 3.5-6 | 0.05-1.0 | up to 2.0 wt. % | up to 2.5 wt. % | Balance |
| Alloy C | 4-5.5 | 0.10-0.75 | up to 2.0 wt. % | up to 2.5 wt. % | Balance |

Alloy A comprises (and in some instances consists essentially of) from about 2 wt. % Mg to about 7 wt. % Mg, from about 0.05 wt. % Cu to about 2.0 wt. % Cu, optionally up to 2.0 wt. % Zn, optionally up to 2.5 wt. % total in additives (e.g., Mn, Zr, as described below) the balance being aluminum and unavoidable impurities.

Alloy B comprises (and in some instances consists essentially of) from about 3.5 wt. % Mg to about 6 wt. % Mg, from about 0.05 wt. % Cu to about 1.0 wt. % Cu, optionally up to 2.0 wt. % Zn, optionally up to 2.5 wt. % total in additives (e.g., Mn, Zr, as described below) the balance being aluminum and unavoidable impurities.

Alloy C comprises (and in some instances consists essentially of) from about 4 wt. % Mg to about 5.5 wt. % Mg, from about 0.05 wt. % Cu to about 0.75 wt. % Cu, optionally up to 2.0 wt. % Zn, optionally up to 2.5 wt. % total in additives (e.g., Mn, Zr, as described below) the balance being aluminum and unavoidable impurities.

Processing with Solution Heat Treating

In one approach, the new 5xxx aluminum alloys realize an improved combination of properties by solution heat treating the alloy, as described in further detail below. The below processes are generally described relative to rolled products (e.g., sheet and plate). However, such processes may be adapted for other wrought product forms, such as extrusions and forgings, using conventional processing techniques known to those skilled in the art.

One embodiment of a method for producing the new 5xxx aluminum alloy products is illustrated in FIG. 3. The method (300) may include the steps of forming a 5xxx aluminum alloy body by direct-chill casting (310), scalping and homogenizing (320). After homogenization, the new 5xxx aluminum alloy body may be hot worked (330), sometimes referred to as hot rolled, to an intermediate gauge (the hot rolled gauge).

After hot rolling, the new 5xxx aluminum alloy body may be solution heat treated (340) by heating the new 5xxx aluminum alloy body to a suitable temperature, holding at that temperature long enough to allow at least some of the copper (if not the majority of the Cu, or substantially all of the Cu) to enter into solid solution and cooling rapidly enough (e.g., via quenching) to hold the constituents in solution. The appropriate solution heat treatment practice is dependent on product form and the amount of copper in the alloy. In one embodiment, the new 5xxx aluminum alloy product is a plate product containing about 5 wt. % Mg, about 0.25 wt. % Cu, having an intermediate gauge of about 2 inches and is solution heat treated at about 900° F. for about 2 hours.

Stated differently, the new 5xxx aluminum alloy products may be processed to a T temper after hot rolling. Under the Aluminum Association rules, a T temper means that the alloy product is thermally treated to produce a stable temper other than F, O, or H tempers. A T temper applies to products that are thermally treated, with or without supplementary cold work (discussed below), to produce stable tempers. The T is always followed by one or more digits. In one embodiment, a new 5xxx aluminum alloy product is processed to one of a T3, T4, T6, T8 and T9 temper. In one embodiment, the new 5xxx aluminum alloy product is processed to a T3 temper.

A T3 temper means that an alloy product is solution heat-treated, cold worked, and naturally aged to a substantially stable condition. A T3 temper may be apply to products that are cold worked to improve strength after solution heat-treatment, or in which the effect of cold work in flattening or straightening is recognized in mechanical property limits.

A T4 temper means solution heat-treated and naturally aged to a substantially stable condition. A T4 temper may apply to products that are not cold worked after solution heat-treatment, or in which the effect of cold work in flattening or straightening may not be recognized in mechanical property limits.

A T5 temper means cooled from an elevated temperature shaping process and then artificially aged, and may apply to products that are not cold worked after cooling from an elevated temperature shaping process, or in which the effect of cold work in flattening or straightening may not be recognized in mechanical property limits.

A T6 temper means solution heat-treated and then artificially aged. A T6 temper may apply to products that are not cold worked after solution heat-treatment, or in which the effect of cold work in flattening or straightening may not be recognized in mechanical property limits.

A T7 temper means solution heat-treated and overaged/stabilized. A T7 temper may apply to wrought products that are artificially aged after solution heat-treatment to carry them beyond a point of maximum strength to provide control of some significant characteristic.

A T8 temper means solution heat-treated, cold worked, and then artificially aged. A T8 temper may apply to products that are cold worked to improve strength, or in which the effect of cold work in flattening or straightening is recognized in mechanical property limits.

A T9 temper means solution heat-treated, artificially aged, and then cold worked. A T9 temper may apply to products that are cold worked to improve strength.

As noted above, some of the T tempers include cold work. The new 5xxx aluminum alloy products may be optionally cold worked (350), i.e., strain hardened, in a fashion similar to that used to achieve a traditional H1, H2 or H3 temper, although the "H" temper designation may not apply to the new 5xxx aluminum alloy products under a strict interpretation of the Aluminum Association rules since the new 5xxx aluminum alloy products have been solution heat treated. Under Aluminum Association rules, an H1 temper means that the alloy is strain hardened. An H2 temper means that the alloy is strain-hardened and partially annealed. An H3 temper means that the alloy is strain hardened and stabilized (e.g., via low temperature heating). In some embodiments, the new 5xxx aluminum alloy products may be strain hardened in accordance with typical H1X, H2X or an H3X temper practices, where X is a whole number from 0-9. This second digit following the designations H1, H2, H3 indicate the final degree of strain hardening. The number 8 is assigned to tempers having a final degree of strain-hardening equivalent to that resulting from approximately 75% reduction in area. Tempers between that of the 0 temper (annealed) and 8 (full hard) are designated by the numbers 1 through 7. A number 4 designation is considered half-hard; number 2 is considered quarter-hard; and the number 6 is three-quarter hard. When the number is odd, the limits of ultimate strength are about halfway between those of the even numbered tempers. An H9 temper has a minimum ultimate tensile strength that exceeds the ultimate tensile strength of the H8 temper by at least 2 ksi.

In one approach, the cold working step (350) is similar to that used to produce a conventional H131 temper, even though a solution heat treatment step (340) is employed. An H131 temper typically means that a material is cold rolled to final gauge, where the cold rolling reduces the thickness of the plate from about 10% to about 30%, (e.g., about 20%), followed by deformation (e.g., stretching the plate for flatness). In one embodiment, the new 5xxx aluminum alloy product is processed using conventional H131 practices by cold rolling to final gauge followed by deformation. The cold rolling may achieve a reduction in thickness (e.g., in the range of 10-70%, or 10-50%).

Although the "T" and "H" temper designations provided above have been used for descriptive purposes, they are not intended to limit the new 5xxx aluminum alloy products to any particular temper designation. For example, although the processing of the new 5xxx aluminum alloy products may place them in the category of "T" temper per the strict construction of the Aluminum Association rules, the actual products sold and marketed may not be labeled "T" temper. Since no other known commercial 5xxx aluminum alloy products are processed in the T temper, the Aluminum Association may determine that it is confusing to apply a T temper designation to the new 5xxx aluminum alloy products. It is conceivable that the Aluminum Association may require the use of an "H" temper designation relative to the new 5xxx aluminum alloy products, even though they have been solution heat treated.

After solution heat treating (340), the new 5xxx aluminum alloy product may be subjected to and optional cold working (350), described above, and/or optional post-SHT practices (360), such as quenching, artificially aging (e.g., to increase ductility), and/or annealing (e.g., to improve corrosion resistance for marine applications). If a quenching step is employed, it generally occurs immediately following the solution heat treatment step, and may facilitate maintenance of the copper in solid solution. Optional artificial aging may occur after solution heat treatment (e.g., for a T6-style temper), or after cold work (e.g., for a T8-style temper), and may facilitate improved ductility. Optional annealing may occur after solution heat treatment and/or cold work to stabilize the product. The optional annealing step may be useful in producing new 5xxx aluminum alloy products having higher corrosion resistance, which may be useful for marine applications.

The new 5xxx aluminum alloy product may be deformed (e.g., for stress relief) an appropriate amount. In one embodiment, the product is deformed via stretching (e.g., for rolled and/or extruded products). In one embodiment, the product is deformed via compression (e.g., for step-extruded and/or forged products). In one embodiment, the product is deformed at least about 1%. In other embodiments, the product is deformed at least about 1.5%, or at least about 2%, or at least about 2.5%, or at least about 3%, or at least about 3.5%, or at least about 4%, or at least about 4.5%, or at least about 5%. In one embodiment, the product is deformed not more than about 12%. In other embodiments, the product is deformed not greater than about 10%, or not greater than about 8%.

For rolled products, the final product may be in the form of a sheet or a plate. In one embodiment, the final product may be a sheet having a thickness of not greater than about 0.249 inches. In one embodiment, the final product is a plate having a thickness of at least about 0.250 inches. In one embodiment, the plate has a thickness in the range of from about 0.5 or 1 inch to about 2 inches, or about 3 inches or about 4 inches. In other embodiments, the final product may be an extrusion or forging.

Although shown as separate steps in FIG. 3, in some embodiments, the hot working (330) and solution heat treatment (340) steps may be completed concomitant to one another (e.g., contemporaneously, such as when the hot working step is sufficiently hot to solutionize the copper in the new 5xxx aluminum alloy body). This type of operation is known to those skilled in the art as "press quenching". In some embodiments, a press quenching operation results in a T5-type temper (with or without artificial aging).

Processing without Solution Heat Treating

In another approach, the new 5xxx aluminum alloy products may be produced without a solution heat treatment step. In these embodiments, the new 5xxx aluminum alloy products may be processed similar to that described above relative to FIG. 3, but in the absence of a solution heat treatment step. In some of these embodiments, the new 5xxx aluminum alloy products are processed to an H temper, such as any of the H tempers described above. In one approach, the cold work used produces a product having an H131 temper. An H131 temper typically means that a material is cold rolled to final gauge, where the cold rolling reduces the thickness of the plate from about 10% to about 30%, (e.g., about 20%), followed by deformation (e.g., stretching the plate for flatness). In one embodiment, the new 5xxx aluminum alloy product is processed using conventional H131 practices by cold rolling to final gauge followed by deformation. The cold rolling may achieve a reduction in thickness (e.g., in the range of 10-70%).

In the embodiments in which a solution heat treatment step is not employed, the alloys generally include manganese, such as at least about 0.3 wt. % Mn. The new 5xxx aluminum alloy products that include both Cu and Mn, and which are strain hardened to an H temper, generally realize improved properties, as described in further detail below.

Composition

As noted above, the new 5xxx aluminum alloys generally include from about 2 wt. % to about 7 wt. % Mg. The amount of Mg used in the alloy may affect its strength, ductility and/or corrosion resistance properties, among others. Higher amounts of Mg may increase strength, but reduce ductility and/or corrosion resistance. Those skilled in the art are able to select an amount of Mg within the 2 wt. % to 7 wt. % range for the new 5xxx aluminum alloy products so that such products achieve the appropriate strength, ductility and/or corrosion resistance, among other properties. In some embodiments, the new 5xxx aluminum alloys includes at least about 2.5 wt. %, or at least about 3 wt. % Mg, or at least about 3.5 wt. % Mg, or at least about 4.0 wt. % Mg. In some embodiments, the new 5xxx aluminum alloys includes not greater than about 6.5 wt. % Mg, or not greater than about 6.0 wt. % Mg, or not greater than about 5.5 wt. % Mg.

The new 5xxx aluminum alloys include 0.05 wt. % to about 2 wt. % copper. The amount of copper within the new 5xxx aluminum alloys should be large enough so as to facilitate improved properties via solution heat treating and/or strain hardening, as noted above. However, the amount of copper should be limited if corrosion resistance is an important property since too much copper can decrease corrosion resistance under some circumstances. Also, higher amounts of copper may exceed the solubility limit of the alloy when employed with alloying containing higher amounts of magnesium. In one embodiment, the new 5xxx aluminum alloys include not greater than about 1.5 wt. % Cu. In other embodiments, the new 5xxx aluminum alloys include not greater than about 1.25 wt. % Cu, or not greater than about 1.0 wt. % Cu, or not greater than about 0.9 wt. % Cu, or not greater than about 0.8 wt. % Cu, or not greater than about 0.75 wt. % Cu, or not greater than about 0.7 wt. % Cu, or not greater than about 0.65 wt. % Cu, or not greater than about 0.6 wt. % Cu, or not greater than about 0.55 wt. % Cu, or not greater than about 0.5 wt. % Cu. In one embodiment, the new 5xxx aluminum alloys include at least about 0.1 wt. % Cu. In other embodiments, the new 5xxx aluminum alloys include at least about 0.15 wt. % Cu, or at least about 0.20 wt. % Cu, at least about 0.25 wt. % Cu.

The new 5xxx aluminum alloys may optionally include zinc (Zn). Zinc may facilitate, among other things, improved strength and/or corrosion resistance of the new 5xxx aluminum alloys. When purposeful additions of zinc are included in the alloy, zinc is generally present in amount of at least about 0.30 wt. %. In one embodiment, the new 5xxx aluminum alloy may include at least about 0.35 wt. % Zn. In other embodiments, the new 5xxx aluminum alloy may include at least about 0.40 wt. % Zn, or at least about 0.45 wt. % Zn, or at least about 0.50 wt. % Zn, or at least about 0.55 wt. % Zn, or at least about 0.60 wt. % Zn. In one embodiment, the new 5xxx aluminum alloy includes not greater than about 2 wt. % Zn. In other embodiments, the new 5xxx aluminum alloy includes not greater than about 1.5 wt. % Zn, or not greater than about 1.25 wt. % Zn, or not greater than about 1.20 wt. % Zn, or not greater than about 1.15 wt. % Zn, or not greater than about 1.10 wt. % Zn, or not greater than about 1.05 wt. % Zn, or not greater than about 1.0 wt. % Zn, or not greater than about 0.95 wt. % Zn, or not greater than about 0.90 wt. % Zn, or not greater than about 0.85 wt. % Zn, or not greater than about 0.80 wt. % Zn. In other embodiments, zinc may be present in the alloy as an unavoidable impurity, as described above.

The new 5xxx aluminum alloys generally include magnesium and copper, as described above, optionally up to 2.0 wt. % Zn, optionally, up to 2.5 wt. % additives, the balance being aluminum and unavoidable impurities. Optional additives include grain structure control materials (sometimes called dispersoids), grain refiners, and/or deoxidizers, among others, as described in further detail below. Some of the optional additives used in the new 5xxx aluminum alloys may assist the alloy in more ways than described below. For example, additions of Mn can help with grain structure control, but Mn can also act as a strengthening agent. Thus, the below description of the optional additives is for illustration purposes only, and is not intended to limit any one additive to the functionality described.

The optional additives may be present in an amount of up to about 2.5 wt. % in total. For example, Mn (1.5 wt. % max), Zr (0.5 wt. % max), and Ti (0.10 wt. % max) could be included in the alloy for a total of 2.1 wt. %. In this situation, the remaining other additives, if any, could not total more than 0.4 wt. %. In one embodiment, the optional additives are present in an amount of up to about 2.0 wt. % in total. In other embodiments, the optional additives are present in an amount of up to about 1.5 wt. %, or up to about 1.25 wt. %, or up to about 1.0 wt. % in total.

Grain structure control materials are elements or compounds that are deliberate alloying additions with the goal of forming second phase particles, usually in the solid state, to control solid state grain structure changes during thermal processes, such as recovery and recrystallization. For the new 5xxx aluminum alloys disclosed herein, Zr and Mn are useful grain structure control elements. Substitutes from Zr and/or Mn (in whole or in part) include Sc, V, Cr, and Hf, to name a few. The amount of grain structure control material utilized in an alloy is generally dependent on the type of material utilized for grain structure control and the alloy production process.

The new 5xxx aluminum alloys may optionally include manganese (Mn). Manganese may serve to facilitate increases in strength and/or a facilitate a refined grain structure, among other things. When manganese is included in the new 5xxx aluminum alloy, it is generally present in amounts of at least about 0.05 wt. %. In one embodiment, the new 5xxx aluminum alloy includes at least about 0.10 wt. % Mn. In other embodiments, the new 5xxx aluminum alloy may include at least about 0.20 wt. % Mn, or at least about 0.30 wt. % Mn, at least about 0.35 wt. % Mn, or at least about 0.40 wt. % Mn. In one embodiment, the new 5xxx aluminum alloy includes not greater than about 1.5 wt. % Mn. In other embodiments, the new 5xxx aluminum alloy includes not greater than about 1.25 wt. % Mn, or not greater than about 1.20 wt. % Mn, or not greater than about 1.15 wt. % Mn, or not greater than about 1.10 wt. % Mn, or not greater than about 1.05 wt. % Mn, or not greater than about 1.0 wt. % Mn, or not greater than about 0.95 wt. % Mn, or not greater than about 0.90 wt. % Mn, or not greater than about 0.85 wt. % Mn, or not greater than about 0.80 wt. % Mn.

When zirconium (Zr) is included in the alloy, it may be included in an amount up to about 0.5 wt. %, or up to about 0.4 wt. %, or up to about 0.3 wt. %, or up to about 0.2 wt. %. In some embodiments, Zr is included in the alloy in an amount of 0.05-0.25 wt. %. In one embodiment, Zr is included in the alloy in an amount of 0.05-0.15 wt. %. In another embodiment, Zr is included in the alloy in an amount of 0.08-0.12 wt. %.

Grain refiners are inoculants or nuclei to seed new grains during solidification of the alloy. An example of a grain refiner is a ⅜ inch rod comprising 96% aluminum, 3% titanium (Ti) and 1% boron (B), where virtually all boron is present as finely dispersed $TiB_2$ particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., $TiB_2$) or carbon (TiC), although other grain refiners, such as Al—Ti master alloys may be utilized. Generally, grain refiners are added in an amount of ranging from 0.0003 wt. % to 0.005 wt. % to the alloy, depending on the desired as-cast grain size. In addition, Ti may be separately added to the alloy in an amount up to 0.03 wt. % to increase the effectiveness of grain refiner. When Ti is included in the alloy, it is generally present in an amount of up to about 0.10 or 0.20 wt. %.

Some alloying elements, generally referred to herein as deoxidizers (irrespective of whether the actually deoxidize), may be added to the alloy during casting to reduce or restrict (and is some instances eliminate) cracking of the ingot resulting from, for example, oxide fold, pit and oxide patches. Examples of deoxidizers include Ca, Sr, Be, and Bi. When calcium (Ca) is included in the alloy, it is generally present in an amount of up to about 0.05 wt. %, or up to about 0.03 wt. %. In some embodiments, Ca is included in the alloy in an amount of 0.001 to about 0.03 wt. % or to about 0.05 wt. %, such as in the range of 0.001-0.008 wt. % (i.e., 10 to 80 ppm). Strontium (Sr) and/or bismuth (Bi) may be included in the alloy in addition to or as a substitute for Ca (in whole or in part), and may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 500 ppm, such as less than about 250 ppm, or less than about 20 ppm.

Other known additives for 5xxx aluminum alloys include Cd, Ge, In, Mo, Nb, Ni, Sn and Y, among others. These additives may facilitate grain structure control and/or precipitation hardening of the new 5xxx aluminum alloys, among others.

The optional additives may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

As used herein, unavoidable impurities are those materials that may be present in the alloy in minor amounts due to, for example, the inherent properties of aluminum and/or leaching from contact with manufacturing equipment, among others. Iron (Fe) and silicon (Si) are examples of unavoidable impurities generally present in aluminum alloys. The Fe content of the alloy should generally not exceed about 0.25 wt. %. In some embodiments, the Fe content of the alloy is not greater than about 0.15 wt. %, or not greater than about 0.10 wt. %, or not greater than about 0.08 wt. %, or not greater than about 0.05 or 0.04 wt. %. Likewise, the Si content of the alloy should generally not exceed about 0.25 wt. %, and is generally less than the Fe content. In some embodiments, the Si content of the alloy is not greater than about 0.12 wt. %, or not greater than about 0.10 wt. %, or not greater than about 0.06 wt. %, or not greater than about 0.03 or 0.02 wt. %. In some embodiments, zinc (Zn) may be included in the alloy as an unavoidable impurity. In these embodiments, the amount of Zn in the alloy generally does not exceed 0.25 wt. %, such as not greater than 0.15 wt. %, or even not greater than about 0.05 wt. %. Aside from iron, silicon, and zinc, the alloy generally contains no more than 0.05 wt. % of any one other unavoidable impurity, and with the total amount of these other unavoidable impurities not exceeding 0.15 wt. % (commonly referred to as others each ≤0.05 wt. %, and others total ≤0.15 wt. %, as reflected in the Aluminum Association wrought alloy registration sheets, called the Teal Sheets).

Except where stated otherwise, the expression "up to" when referring to the amount of an element means that that elemental composition is optional and includes a zero amount of that particular compositional component. Unless stated otherwise, all compositional percentages are in weight percent (wt. %).

Properties

The new 5xxx aluminum alloys may realize at least equivalent performance to prior art alloys, such as 5083, 5456, and/or 5059, among others, in terms of at least one property, while realizing an improved performance in at least one other property. For example, the new 5xxx aluminum alloy products may achieve an improved combination of properties, such as a combination of at least two of the following: strength, toughness, ductility, corrosion resistance, formability, ballistics performance, fatigue performance, surface quality and/or weldability, among others.

Strength

With respect to strength, the new 5xxx aluminum alloy products may achieve at least a 5% increase in typical (average) strength (e.g., ultimate tensile strength (UTS) or tensile yield strength (TYS)) over the typical strength of a comparable 5xxx aluminum alloy product. Comparable 5xxx aluminum alloy products are those products whose characteristics may be reliably compared on a relative basis to the new 5xxx aluminum alloy product due to, for example, their similar product form (rolled, extruded, forged) and their similar dimensions, among other criteria. However, the comparable 5xxx aluminum alloy products have not been solution heat treated (i.e., are not in the T temper) and/or do not contain copper (e.g., for embodiments in which the new 5xxx aluminum alloy product is not solution heat treated).

In one embodiment, a new 5xxx aluminum alloy product and a comparable 5xxx aluminum alloy product have a generally equivalent composition (e.g., they have a comparable amount of Mg (e.g., within 0.10-0.50 wt. % of each other, depending upon the total magnesium level in the alloy, and/or are within the bounds of the Aluminum Association wrought alloy limits for a particular alloy), except that the new 5xxx aluminum alloy contains at least about 0.05 wt. % Cu and is solution heat treated, whereas the comparable 5xxx aluminum alloy product does not contain copper and/or was not solution heat treated. For example, aluminum alloy 5454 contains 2.4-3.0 wt. % Mg and 0.10 wt. % max Cu (i.e., Cu is listed as an impurity for 5454) per Aluminum Association registration limits. In the H32 temper, 5454 realizes a typical yield strength of about 30 ksi for plate. The new 5xxx aluminum alloy product may have a similar amount of Mg as 5454 (i.e., 2.4-3 wt. %), but with the addition of copper and production in the T temper, the new 5xxx aluminum alloy product may realize, in the same product form (i.e., the same thickness plate), a typical strength of at least about 32 ksi, which is about a 6.7% increase in strength over the standard 5454-H32 product. Similar results may be realized with Aluminum Association alloys 5083 and 5456, among others. Other 5xxx aluminum alloys having 2-7 wt. % Mg and that may realize improved properties with the addition of Cu and/or production in a T temper include 5017, 5018, 5018A, 501914, 5019A, 5119, 5119A, 5021, 5022, 5023, 5024, 5026, 5027, 5041, 5042, 5049, 5149, 5249, 5349, 5449, 5051, 5051A, 5151, 5251, 5251A, 5351, 5451, 5052, 5252, 5352, 51548, 5154A, 5154B, 5154C, 5254, 5354, 5554, 5654, 5654A, 5754, 5954, 5056, 5356, 5356A, 5456A, 5456B, 5556, 5556A, 5556B, 5556C, 5058, 5059, 5070, 5180, 5180A, 5082, 5182, 5183, 5183A, 5283, 5283A, 5283B, 5383, 5483, 5086, 5186, 5087, 5187 and 5088, among others.

In another embodiment, a new 5xxx aluminum alloy product and a comparable 5xxx aluminum alloy product have a generally equivalent composition, except that the new 5xxx aluminum alloy contains at least about 0.05 wt. % Cu and at least about 0.30 wt. % Mn, whereas the comparable 5xxx aluminum alloy product does not contain copper and/or Mn. For example, as shown in FIGS. 1 and 2 of Examples 2-3, described below, Alloy 12-A in the H131 temper realizes a significant improvement in ballistics performance over the comparable 5083 product. Alloy 12-A contains copper and manganese, whereas the 5083 alloy does not.

In one embodiment, a new 5xxx aluminum alloy product achieves at least a 6% increase in strength over a comparable 5xxx aluminum alloy product. In other embodiment, the new 5xxx aluminum alloy product achieves at least a 7% increase, or at least an 8% increase, or at least a 9% increase, or at least a 10% increase, at least an 11% increase, at least a 12% increase, at least a 13% increase, or at least a 14% increase, or at least a 15% increase, or at least a 16% increase, or at least a 17% increase, or at least an 18% increase, or at least an 19% increase, or at least an 20% increase in strength over a comparable 5xxx aluminum alloy product. In some of these embodiments, the ductility of the new 5xxx aluminum alloy product is at least as good as that of the comparable 5xxx aluminum alloy product. In some of these embodiments, the corrosion resistance of the new 5xxx aluminum alloy product is at least as good as that of the comparable 5xxx aluminum alloy product. In some of these embodiments, the ballistics performance of the new 5xxx aluminum alloy products is at least as good as that of a comparable 5xxx aluminum alloy product.

The measured strength value for the new 5xxx aluminum alloy product is dependent upon composition and product form. High amounts of magnesium generally produce high strength, but can reduce corrosion resistance. Thicker products generally will have a lower strength than thinner products. For low magnesium embodiments, the new 5xxx aluminum alloy products may realize a yield strength of at least about 30 ksi. In the higher magnesium embodiments, the new 5xxx aluminum alloy products may realize a yield strength of at least about 50 ksi. Higher yield strengths may be realized, such as at least about 51 ksi, or at least about 52 ksi, or at least about 53 ksi, or at least about 54 ksi, or at least about 55 ksi, or at least about 56 ksi, or more. In any event, the new 5xxx aluminum alloy products realize at least a 5% increase in strength over the comparable 5xxx aluminum alloy products, as described above.

In one embodiment, the new 5xxx aluminum alloy products realize an elongation of at least about 5%. In other embodiments, the new 5xxx aluminum alloy products realize an elongation of at least about 6%, or at least about 7%, or at least about 8%, or at least about 9%, or at least about 10%.

Ultimate tensile strength (UTS), tensile yield strength (TYS), and elongation (El) and may be measured in accordance with ASTM B557 and E8.

Corrosion Resistance

The new 5xxx aluminum alloy products may also realize improved corrosion resistance. In one embodiment, the new 5xxx aluminum alloy products achieve improved intergranular corrosion resistance. With respect to a non-sensitized condition, in one embodiment, the new 5xxx aluminum alloy products may realize a mass of loss of not greater than about 2.5 mg/cm$^2$ when tested for intergranular corrosion in accordance with ASTM Standard G67. In other embodiments, the new 5xxx aluminum alloy product may realize a mass loss of not greater than about 2.4 mg/cm$^2$, or not greater than about 2.3 mg/cm$^2$, or not greater than about 2.2 mg/cm$^2$, or not greater than about 2.1 mg/cm$^2$, or not greater than about 2.0 mg/cm$^2$, or not greater than about 1.9 mg/cm$^2$, or not greater than about 1.8 mg/cm$^2$, or not greater than about 1.7 mg/cm$^2$.

A non-sensitized condition means that the alloy product is tested for corrosion resistance, without artificial age sensitizing, after fabrication, but before the alloy product is placed in service. A sensitized condition means that the alloy product is tested for corrosion resistance after artificial age sensitizing. Age sensitizing means that the aluminum alloy product has been artificially aged to a condition representative of at least 20 years of service life. For example, the aluminum alloy product may be continuously exposed to elevated temperature for several days (e.g., a temperature in the range of about 100° C.-120° C. for a period of about 7 days).

In one embodiment, the new 5xxx aluminum alloy products realize at least about 5% better intergranular corrosion resistance than a comparable 5xxx aluminum alloy product, as compared in a non-sensitized condition. For example, if a comparable aluminum alloy product realizes a mass loss of 2.75 mg/cm$^2$, and if the new 5xxx aluminum alloy product realizes a mass loss of 2 mg/cm$^2$, then the new 5xxx aluminum alloy product would have a 27.3% better intergranular corrosion resistance performance than the comparable 5xxx aluminum alloy (27.3%=1−(2.0 mg/cm$^2$/2.75 mg/cm$^2$)). In other embodiments, the new 5xxx aluminum alloy product realizes at least about 10%, or at least about 15%, or at least about 20%, or least about 25%, or at least about 30%, or at least about 35% better, or least about 40%, or at least about 45%, or at least about 50%, or at least about 55%, or at least about 60% better intergranular corrosion resistance performance than a comparable 5xxx aluminum alloy product, as compared in a non-sensitized condition. In one embodiment the comparable aluminum alloy product is 5083. In another embodiment, the comparable aluminum alloy product is 5056.

In one embodiment, the new 5xxx aluminum alloy products realize at least about 0.5 mg/cm$^2$ less mass loss than a comparable 5xxx aluminum alloy product, as compared in a non-sensitized condition. In other embodiments, the new 5xxx aluminum alloy products realize at least 0.6 mg/cm$^2$ less, or at least about 0.7 mg/cm$^2$ less, or at least about 0.8 mg/cm$^2$ less, or at least about 0.9 mg/cm$^2$ less mass loss, or at least 1.0 mg/cm$^2$ less, or at least about 1.5 mg/cm$^2$ less, or at least about 1.75 mg/cm$^2$ less, or at least about 2.0 mg/cm$^2$ less, or at least about 2.25 mg/cm$^2$ less, or at least about 2.5 mg/cm$^2$ less, or at least about 2.75 mg/cm$^2$ less mass loss than a comparable 5xxx aluminum alloy product, as compared in a non-sensitized condition. In one embodiment the comparable aluminum alloy product is 5083. In another embodiment, the comparable aluminum alloy product is 5056.

With respect to a sensitized condition, in one embodiment, the new 5xxx aluminum alloy products may realize a mass of loss of not greater than about 35 mg/cm$^2$ when tested for intergranular corrosion in accordance with ASTM Standard G67. In other embodiments, the new 5xxx aluminum alloy products may realize a mass loss of not greater than about 30 mg/cm$^2$, or not greater than about 25 mg/cm$^2$, or not greater than about 20 mg/cm$^2$, or not greater than about 15 mg/cm$^2$, or not greater than about 12.5 mg/cm$^2$, or not greater than about 10 mg/cm$^2$, or not greater than about 9 mg/cm$^2$ in a sensitized condition.

In one embodiment, the new 5xxx aluminum alloy products realize at least about 5% better intergranular corrosion resistance performance than a comparable 5xxx aluminum alloy product, as compared in a sensitized condition. For example, if a comparable 5xxx aluminum alloy product realizes a mass loss of 45 mg/cm$^2$, and the new 5xxx aluminum alloy product realizes a mass loss of 35 mg/cm$^2$, then the new 5xxx aluminum alloy product would have a 22.2% better intergranular corrosion resistance performance than the comparable 5xxx aluminum alloy product (22.2%=1−(35 mg/cm$^2$/45 mg/cm$^2$)). In other embodiments, the new 5xxx aluminum alloy product realizes at least about 10%, or at least about 20%, or at least about 30%, or least about 40%, or at least about 50%, or at least about 60% better, or at least about 70% better, or at least about 80% better intergranular corrosion resistance performance than a comparable aluminum alloy product, as compared in a sensitized condition. In one embodiment the comparable aluminum alloy product is 5083. In another embodiment, the comparable aluminum alloy product is 5056.

In one embodiment, the new 5xxx aluminum alloy products realize at least about 5 mg/cm$^2$ less mass loss than a comparable 5xxx aluminum alloy product, as compared in a sensitized condition. In other embodiments, the new 5xxx aluminum alloy products realize at least 10 mg/cm$^2$ less, or at least about 15 mg/cm$^2$ less, or at least about 20 mg/cm$^2$ less, or at least about 25 mg/cm$^2$ less, or at least about 30 mg/cm$^2$ less, or at least about 31 mg/cm$^2$ less, or at least about 32 mg/cm$^2$ less, or at least about 33 mg/cm$^2$ less, or at least about 34 mg/cm$^2$ less, or at least about 35 mg/cm$^2$ less, or at least about 36 mg/cm$^2$ less, or at least about 37 mg/cm$^2$ less, or at least about 38 mg/cm$^2$ less mass loss than a comparable 5xxx aluminum alloy, as compared in a sensitized condition.

Intergranular corrosion resistance testing may be accomplished in accordance with ASTM Standard G67.

Ballistics Performance

The new 5xxx aluminum alloy products may realize improved ballistics performance. In one embodiment, the new 5xxx aluminum alloy products realize improved armor piercing (AP) performance. In one embodiment, the new 5xxx aluminum alloy products realize improved fragment simulation projectile (FSP) resistance. In one embodiment, the new 5xxx aluminum alloy products realize at least one of (i) equivalent ballistics performance at substantially reduced weights (ii), or substantially improved ballistics performance at equivalent weights, relative to comparable prior art 5xxx aluminum alloys.

In one embodiment, the new 5xxx aluminum alloy products weigh at least about 1% less than comparable 5xxx aluminum alloys while achieving equivalent or better ballistics performance (e.g., V50 resistance for either FSP or AP). In other embodiments, the new 5xxx aluminum alloy products weigh at least about 2% less, or at least about 3% less, at least about 4% less, or at least about 5% less, or at least about 6% less, or at least about 7% less, or at least about 8% less, or at least about 9% less, or at least about 10% less, or at least about 11% less, or at least about 12% less, or at least about 13% less than a comparable 5xxx aluminum alloy product while achieving equivalent or better ballistics performance (e.g., V50 for either FSP or AP). As known to those skilled in the art, V50 is the velocity at which about 50% of the shots will go through a test material, while the other about 50% are stopped by the test material.

In one embodiment, the new 5xxx aluminum alloy products achieve at least about 1% better V50 (AP and/or FSP) than a comparable 5xxx aluminum alloy product at equivalent areal density. In other embodiments, the new 5xxx aluminum alloy products achieve at least about 2% better V50, or at least about 3% better V50, or at least about 4% better V50, or at least about 5% better V50, at least about 6% better V50, at least about 7% better V50, or at least about 8% better V50, or at least about 9% better V50, or at least about 10% better V50, or at least about 11% better V50, or at least about 12% better V50, or at least about 13% better V50, or at least about 14% better V50, or at least about 15% better V50, or at least about 16% better V50, or at least about 17% better V50, or at least about 18% better V50 than a comparable 5xxx aluminum alloy product at equivalent areal density. In one embodiment, the areal density is calculated by taking the volume of the material required to achieve the V50 performance and multiplying it by the density of that material (e.g., a 12"×12" plate×the gauge of the plate×the density of the plate).

Applications

The new 5xxx aluminum alloys may be used in a variety of product applications. Examples include armor applications (e.g., for vehicle components, such as hulls, doors, roofs, window, and hatches, among others), marine application (e.g., for marine vehicles, such as hulls, decking, bulkhead, superstructures and other structural components, among others) automotive applications (e.g., doors or other portions of an automotive vehicle), and consumer electronics (e.g., casings and facades for portable electronic devices, among others).

Various ones of the unique aspects noted hereinabove may be combined to yield various new 5xxx aluminum alloy products having an improved combination of properties. Additionally, these and other aspects and advantages, and novel features of this new technology are set forth in part in the description that follows and will become apparent to those skilled in the art upon examination of the following description and figures, or may be learned by practicing one or more embodiments of the technology provided for by the present disclosure.

DETAILED DESCRIPTION

Example 1

Figure 1:
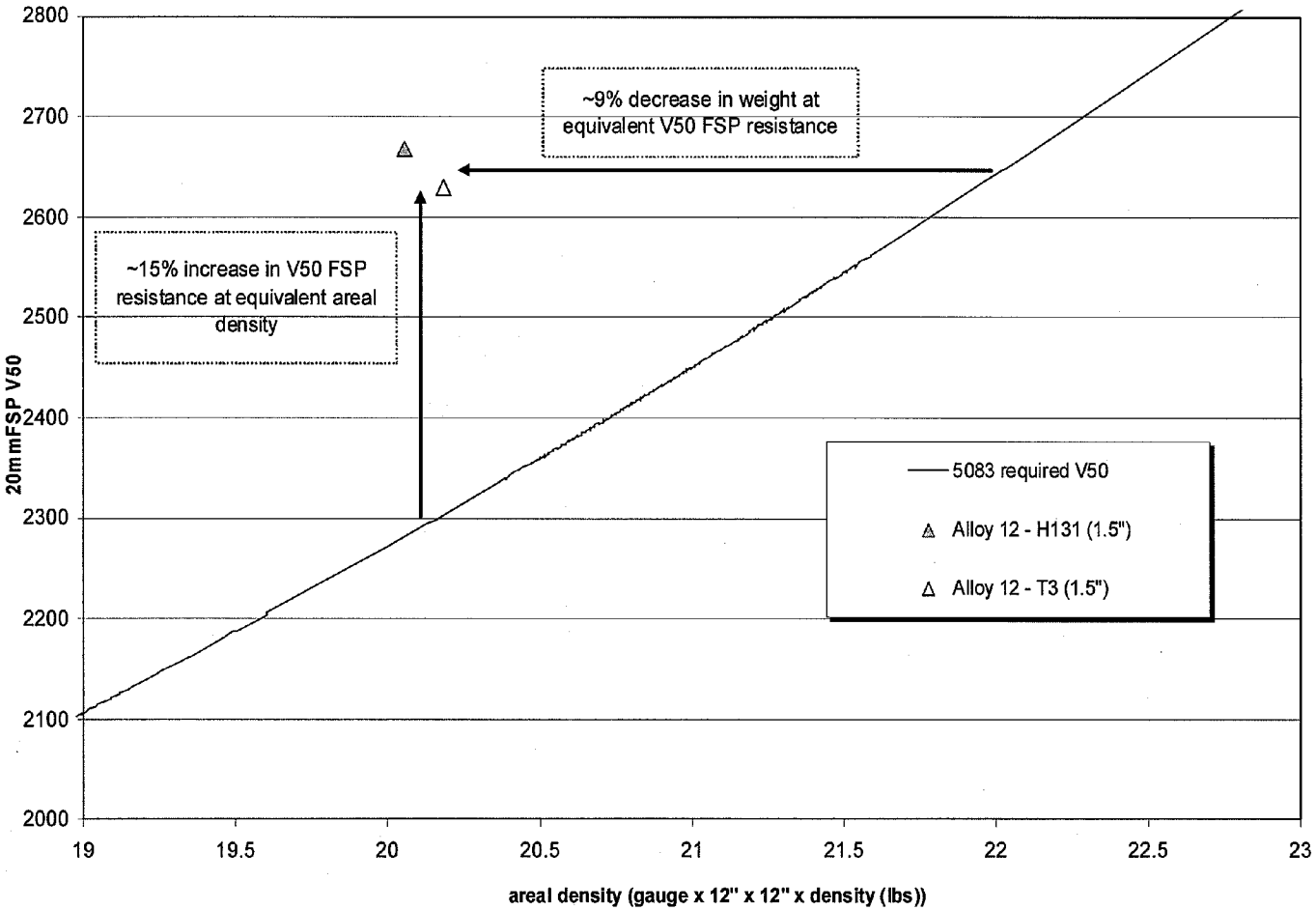
FIG. 1 is a graph illustrating the FSP ballistics performance of various 5xxx aluminum alloy products.

Ten book mold castings are produced, and the constituents of each casting are listed in Table 2, below (all values in weight percent), the balance being aluminum and unavoidable impurities (all alloys contained ≤0.05 wt. % each of Fe and Si). A 3:1 $TiB_2$ grain refiner addition was made for all casts, which were fluxed for five minutes prior to casting.

TABLE 2

Composition of Experimental 5xxx Cast Alloys

| Ex. Alloy | Mg | Cu | Mn | Zn | Sc | Zr | Ti |
|---|---|---|---|---|---|---|---|
| 1 | 5.06 | — | 0.74 | 0.42 | 0.085 | 0.082 | 0.015 |
| 2 | 5.54 | — | 0.74 | 0.42 | 0.099 | 0.076 | 0.014 |
| 3 | 6.02 | — | 0.75 | 0.43 | 0.088 | 0.09 | 0.015 |
| 4 | 4.97 | — | 0.94 | 0.42 | 0.093 | 0.088 | 0.014 |
| 5 | 5.11 | 0.002 | 0.75 | 0.66 | 0.091 | 0.088 | 0.014 |
| 6 | 5.08 | 0.2 | 0.75 | 0.48 | 0.084 | 0.082 | 0.014 |
| 7 | 5.07 | 0.37 | 0.74 | 0.43 | 0.079 | 0.08 | 0.017 |
| 8 | 5.09 | 0.56 | 0.73 | 0.43 | 0.092 | 0.083 | 0.014 |
| 9 | 5.51 | 0.36 | 0.73 | 0.43 | 0.079 | 0.084 | 0.019 |
| 10 | 5.55 | 0.37 | 0.94 | 0.43 | 0.076 | 0.086 | 0.014 |

After casting, each book mold has the approximate dimension of 32 mm (thick)×70 mm (width)×150 mm (length). The castings are homogenized as follows:

Ramp to 260° C. (500° F.) in 4 hrs
Soak at 260° C. (500° F.)+/−2° C. (5° F.) for 5 hrs
Ramp to 315° C. (600° F.) in 2 hrs
Soak at 315° C. (600° F.)+/−2° C. (5° F.) for 5 hrs
Ramp to 455° C. (850° F.) in 5 hrs
Soak at 455° C. (850° F.)+/−2° C. (5° F.) for 4 hrs
Air cool After homogenization all the book molds are scalped to remove ~3 mm (~0.125") from both rolling faces. The sides of the book molds are also slightly surface machined, and one end of each book mold is machined to have a "nose" (taper) for hot rolling. The book molds are then pretreated at about 425 to 455° C. for about 30 to 60 minutes and then hot rolled to an intermediate gauge of about 12 mm. The book molds are then reheated to about 425 to 455° C. for about 3 to 4 hours. The book molds are then hot rolled to a final gauge of about 5.5 mm. A final hot roll exit temperature of ~260° C. is targeted.

Each book mold is then cut into two halves (about 300 mm in length) and machined on the edges. One piece of each book mold is cold rolled about 30% to a nominal thickness of about 4.1 mm and the other piece of each book mold is cold rolled about 50% to a nominal gauge of about 2.8 mm.

Each of the rolled alloys are tested for tensile yield strength, ultimate tensile strength and elongation per ASTM B557 and E8 at the (e.g., at the T/2 location). The test results are provided below in Table 3.

TABLE 3

Tensile Results of Experimental 5xxx Cast Alloys - 30% and 50% cold work

| | Average - 30% CW | | | Average - 50% CW | | |
|---|---|---|---|---|---|---|
| Alloy | TYS (MPa) | UTS (MPa) | El (%) | TYS (MPa) | UTS (MPa) | El (%) |
| 1 | 398.5 | 444.0 | 10 | 429.3 | 465.3 | 6 |
| 2 | 412.0 | 465.5 | 8 | 452.8 | 495.5 | 8 |
| 3 | 421.0 | 482.0 | 9 | 465.3 | 517.8 | 8 |
| 4 | 409.0 | 458.8 | 10 | 450.8 | 485.3 | 6.5 |
| 5 | 407.0 | 459.0 | 10 | 439.5 | 480.3 | 7 |
| 6 | 414.0 | 459.8 | 10 | 447.5 | 483.5 | 6 |
| 7 | 426.0 | 471.3 | 8 | 458.5 | 490.0 | 5 |
| 8 | 436.5 | 468.8 | 7 | 466.5 | 498.5 | 5 |
| 9 | 437.5 | 489.8 | 10 | 464.0 | 500.5 | 6 |
| 10 | 445.5 | 494.5 | 8 | 480.8 | 523.0 | 6 |

These data illustrate that alloys having no copper (experimental alloys 1-5) generally achieve lower tensile strengths than alloys having copper (experimental alloys 6-10), in both the 30% and 50% cold worked alloys, illustrating the beneficial strengthening effect of copper additions.

Alloy 6 demonstrates that copper may improve strength at levels of at least about 0.2 wt. %. Alloy 6 realizes about a 4% increase in strength (TYS and UTS) over Alloy 1, which contains similar levels of Mg, Zn and optional additives and unavoidable impurities, at similar amounts of cold work, but no copper.

Alloy 7 demonstrates that copper levels of about 0.4 wt. % continues to increases the strength of the alloys. Alloy 7 realizes about a 6.9% increase in tensile yield strength over Alloy 1, which contains similar levels of Mg, Zn and optional additives and unavoidable impurities, at similar amounts of cold work, but no copper.

Alloy 8 demonstrates that copper levels of about 0.6 wt. % may realize incremental or no strength increases relative to alloys having about 0.4 wt. % copper. Alloy 8 contains similar levels of Mg, Zn and optional additives and unavoidable impurities as Alloy 7, but contains about 0.6 wt. % Cu as opposed to about 0.4 wt. % Cu. Alloy 8 realizes some increase in tensile yield strength (about 2%) at similar cold work, but realizes a decrease in ultimate strength at 30% cold work, and only a 1.2% increase in UTS at 50% cold work.

Alloy 9 demonstrates the benefit of increasing magnesium at similar levels of copper. Alloy 9 contains similar levels of Cu, Zn and optional additives and unavoidable impurities as Alloy 7, but contains about 5.5 wt. % Mg as opposed to about 5.0 wt. % Mg. Alloy 9 realizes both increasing tensile yield strength (about a 2.7% increase with 30% cold work, and a 1.2% increase with 50% cold work) and ultimate tensile strength (about a 3.9% increase with 30% cold work and about a 2.1% increase with 50% cold work). Alloy 2 also illustrates the beneficial strengthening effect of magnesium. Alloys 1 and 2 contain no copper, and similar Zn and optional additives and unavoidable impurities, but Alloy 1 contains about 5.06 wt. % Mg and Alloy 2 contains about 5.5 wt. % Mg. Alloy 2 realizes higher strength than Alloy 1.

Alloy 10 demonstrates the benefit of increasing manganese at similar levels of copper and magnesium. Alloy 10 contains similar levels of Mg, Cu, Zn and optional additives and unavoidable impurities as Alloy 9, except Alloy 10 contains about 0.95 wt. % Mn as opposed to about 0.75 wt. % Mn. Alloy 10 realizes both increasing tensile yield strength (about a 1.8% increase with 30% cold work, and a 3.6% increase with 50% cold work) and ultimate tensile strength (about a 1.0% increase with 30% cold work and about a 4.5% increase with 50% cold work). Alloy 4 also illustrates the beneficial strengthening effect of manganese. Alloys 1 and 4 contain similar Mg, Zn and optional additives and unavoidable impurities, except Alloy 1 contains about 0.75 wt. % Mn and Alloy 4 contains about 0.95 wt. % Mn. Alloy 4 realizes a higher strength while achieving a similar ductility to Alloy 1, indicating the higher levels of Mn may be beneficial.

Alloys 4 and 10 also demonstrate that increased cold work with increased levels of manganese facilitate increases in strength. Alloys 4 and 10 both achieve higher percentage increases in strength at 50% cold work relative to 30% cold work. Alloy 4 realizes about a 5% increase in TYS over Alloy 1 at 50% cold work, but only about a 2.6% increase in TYS over Alloy 1 at 30% cold work. Similarly, alloy 10 realizes about a 3.6% increase in tensile yield strength over Alloy 9 at 50% cold work, but only about a 1.8% increase in tensile yield strength over Alloy 9 at 30% cold work. In other words, the 50% cold work nearly doubles the effect of increased Mn additions over 30% cold work.

Example 2

Two experimental alloys are direct chill cast into ingots. The constituents of each alloy is provided in Table 4 below (all values in weight percent), the balance being aluminum and unavoidable impurities (all alloys contained ≤0.05 wt. % each of Fe and Si).

TABLE 4

Composition of Experimental 5xxx Cast Alloys

| Ex. Alloy | Mg | Cu | Mn | Zn | Cr | Zr | Ti | Si | Fe |
|---|---|---|---|---|---|---|---|---|---|
| 11 | 5.020 | 0.200 | 0.585 | — | 0.088 | 0.110 | 0.019 | 0.027 | 0.048 |
| 12 | 5.020 | 0.492 | 0.56 | — | 0.084 | 0.101 | 0.019 | 0.027 | 0.043 |

The alloy 11 ingot experienced cracking and could not be rolled via industrial scale machinery. Thus, uncracked portions of the alloy 11 ingot were removed for rolling via lab scale machinery. A portion of the alloy 12 ingot was also removed for testing at the lab scale for comparative purposes. These portions had dimensions of 10"×12"×20".

Lab Scale—Alloys 11 and 12

Both the alloy 11 and 12 lab scale portions are processed to a T3 temper in about 1" gauge, per below. The portions sliced from the alloy 11 and alloy 12 ingots are homogenized at 860° F. for 16 hrs, then at 900° F. for 16 hrs, and then at 950° F. for 2 hrs. After homogenization, the portions are hot rolled at about 800-900° F. to a gauge of about 1.5". The portions are then solution heat treated at 900° F. and then cold water quenched. The portions are then rolled to a final gauge of about 1.098 inches. No post rolling deformation is completed.

Industrial Scale—Alloy 12

After scalping, the alloy 12 ingot is homogenized using a three-step practice:

16 hours at 870° F. (furnace set-point)

16 hours at 910° F. (furnace set-point)

2 hours at 960° F. (furnace set-point)

The ingots are broadened about 30% and then hot rolled to a target thickness of about 1.98" target, achieving an actual gauge of 1.94" after cooling.

A first portion of the hot rolled product (referred to as Alloy 12-A) is cold rolled to about 23%, achieving a final gauge of about 1.51 inches thick. The material is then stretched for flatness about 1%.

A second portion of the hot rolled product (referred to as Alloy 12-B) is solution heat treated at 895° F. (furnace set-point) for about 2 hours. The material is then spray quenched with cold water, and then cold rolled to about 23%, achieving a final gauge of about 1.44 inches thick. The material is then stretched for flatness about 1%.

Tensile tests are performed on the alloys in accordance with ASTM B557 and E8. The tensile test results are provided in Table 5 below (specimen from T/2 location).

TABLE 5

Tensile Results of Experimental 5xxx Cast Alloys - H131 and T3 Tempers

| Alloy | Temper | Thickness (in.) | UTS (ksi) | TYS (ksi) | ELO (%) |
|---|---|---|---|---|---|
| 11-lab | T3 | 1.1 | 59.3 | 54.4 | 9.0 |
| 12-lab | T3 | 1.1 | 59.8 | 53.3 | 8.8 |
| 12-A | H131 | 1.5 | 61.8 | 57.6 | 7.1 |
| 12-B | T3 | 1.5 | 67.7 | 61.2 | 7.8 |

With respect to the lab scale alloys, both alloys 11 and 12, each having at least 0.2 wt. % copper, achieve good strength and ductility. With respect to the industrial scale testing of Alloy 12, Alloy 12-B in the T3 temper realizes improved strength and ductility over Alloy 12A in the H131 temper.

The typical composition and properties of prior art alloys 5083 and 5456 are in the H131 properties are provided in Tables 6a and 6b, below.

TABLE 6a

Typical Composition of Prior Art Alloys (all values in weight percent)

| Alloy | Mg | Cu | Mn | Zn | Cr | Zr | Ti | Si | Fe |
|---|---|---|---|---|---|---|---|---|---|
| 5083 | 4.0-4.9 | ≤0.10 | 0.4-1.0 | ≤0.25 | 0.05-0.25 | — | ≤0.15 | ≤0.40 | ≤0.40 |
| 5456 | 4.7-5.5 | ≤0.10 | 0.5-1.0 | ≤0.25 | 0.05-0.20 | — | ≤0.20 | ≤0.25 | ≤0.40 |

TABLE 6b

| Typical Tensile Properties of Prior Art Alloys - T/2 | | | | | |
|---|---|---|---|---|---|
| Alloy | Temper | Thickness (in.) | UTS (ksi) | TYS (ksi) | ELO (%) |
| 5083 | H131 | 1.25-1.5 | 56 | 51.8 | 8.7 |
| 5456 | H131 | 1.5 | 58.8 | 52.5 | 9.7 |

Both alloys 11 and 12, in either the H131 temper or the T3 temper, achieve improved properties relative to these prior art alloys. Both lab scale alloys 11 and 12 achieve improved strength over these prior art alloys. With respect to the industrial scale alloys, Alloy 12-A in the H131 temper achieves about a 10.2% increase in UTS and about an 11.3% increase in TYS relative to 5083. Alloy 12-B in the T3 temper achieves about a 19.8% increase in UTS and about an 18.2% increase in TYS relative to 5083. Alloy 12-A achieves about a 5.0% increase in UTS and about a 9.6% increase in TYS relative to 5456. Alloy 12-B achieves about a 14.2% increase in UTS and about a 16.4% increase in TYS relative to 5456. These results illustrate the beneficial effects of copper additions, irrespective of temper, as well as the beneficial effects of processing Al—Mg—Cu alloys to a T3 temper.

Corrosion Testing

The lab scale plates 11 and 12 and the industrial scale plates 12-A and 12-B are subjected to corrosion testing in accordance with ASTM G67, "Standard Test Method for Determining the Susceptibility to Intergranular Corrosion of 5XXX Series Aluminum Alloys by Mass Loss After Exposure to Nitric Acid (NAMLT Test)". Those test results are provided in Table 7, below, in both the sensitized and non-sensitized conditions.

TABLE 7

| Corrosion Performance of Alloys 11 and 12 | | | | | |
|---|---|---|---|---|---|
| | | Thickness | Mass loss ($mg/cm^2$) | | |
| Alloy | Temper | (in.) | Sample 1 | Sample 2 | Average |
| 11-lab | T3 | 1.1 | 1.90 | 1.89 | 1.89 |
| 11-lab (sensitized) | | | 12.89 | 11.86 | 12.37 |
| 12-lab | T3 | 1.1 | 1.77 | 1.77 | 1.77 |
| 12-lab (sensitized) | | | 7.76 | 10.74 | 9.25 |
| 12-A | H131 | 1.5 | 5.58 | 5.52 | 5.55 |
| 12-A (sensitized) | | | 36.92 | 34.71 | 35.82 |
| 12-B | T3 | 1.5 | 1.91 | 1.89 | 1.90 |
| 12-B (sensitized) | | | 22.46 | 21.38 | 21.92 |
| 5083 (prior art) | H131 | 1.0 | N/A | N/A | 2.75 |
| 5083 (sensitized) | | | N/A | N/A | 43.1 |
| 5059 (prior art) | H321 | 0.787 | N/A | N/A | 4.57 |
| 5059 (sensitized) | | | N/A | N/A | 47.2 |

The experimental alloys in the T3 temper realize better intergranular corrosion performance than prior art alloys 5083 and 5059. The lab alloys (11 and 12) and Alloy 12-B have a mass loss that is about 0.85-1 $mg/cm^2$ less than that of prior art alloy 5083, and a mass loss that is about 2.65-2.8 $mg/cm^2$ less than that of prior art alloy 5083. In the sensitized condition (e.g., after about 1 week @ about 100° C.), the T3 alloys realize at least about 21-38 $mg/cm^2$ less mass loss than the prior art alloys in the sensitized condition.

The lab alloys (11 and 12) both realize similar levels of intergranular corrosion performance, although alloy 12-lab, having slightly more copper, realizes slightly better corrosion performance in the sensitized condition.

Example 3

Figure 2:
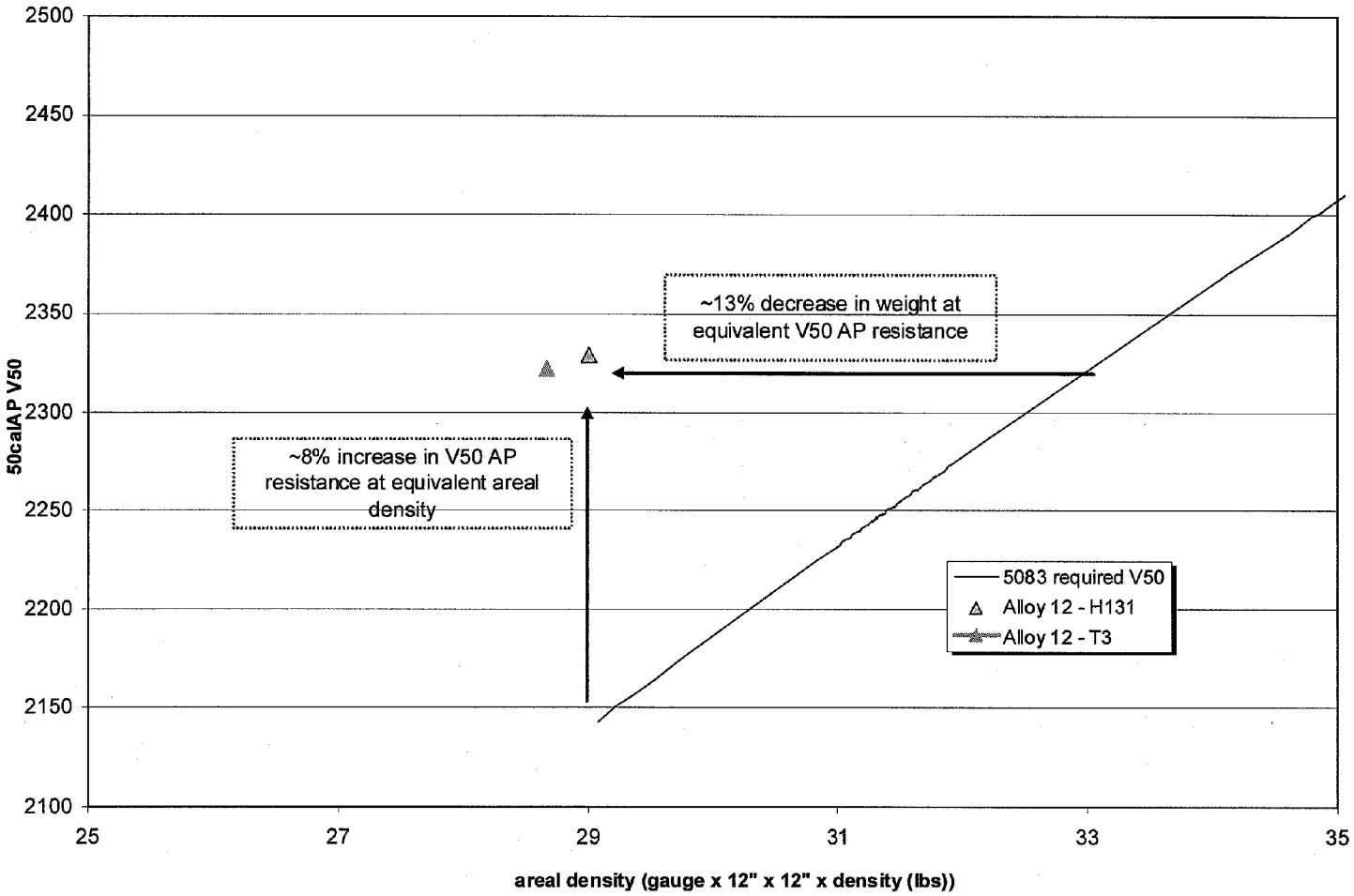
FIG. 2 is a graph illustrating the AP ballistics performance of various 5xxx aluminum alloy products.
Figure 3:
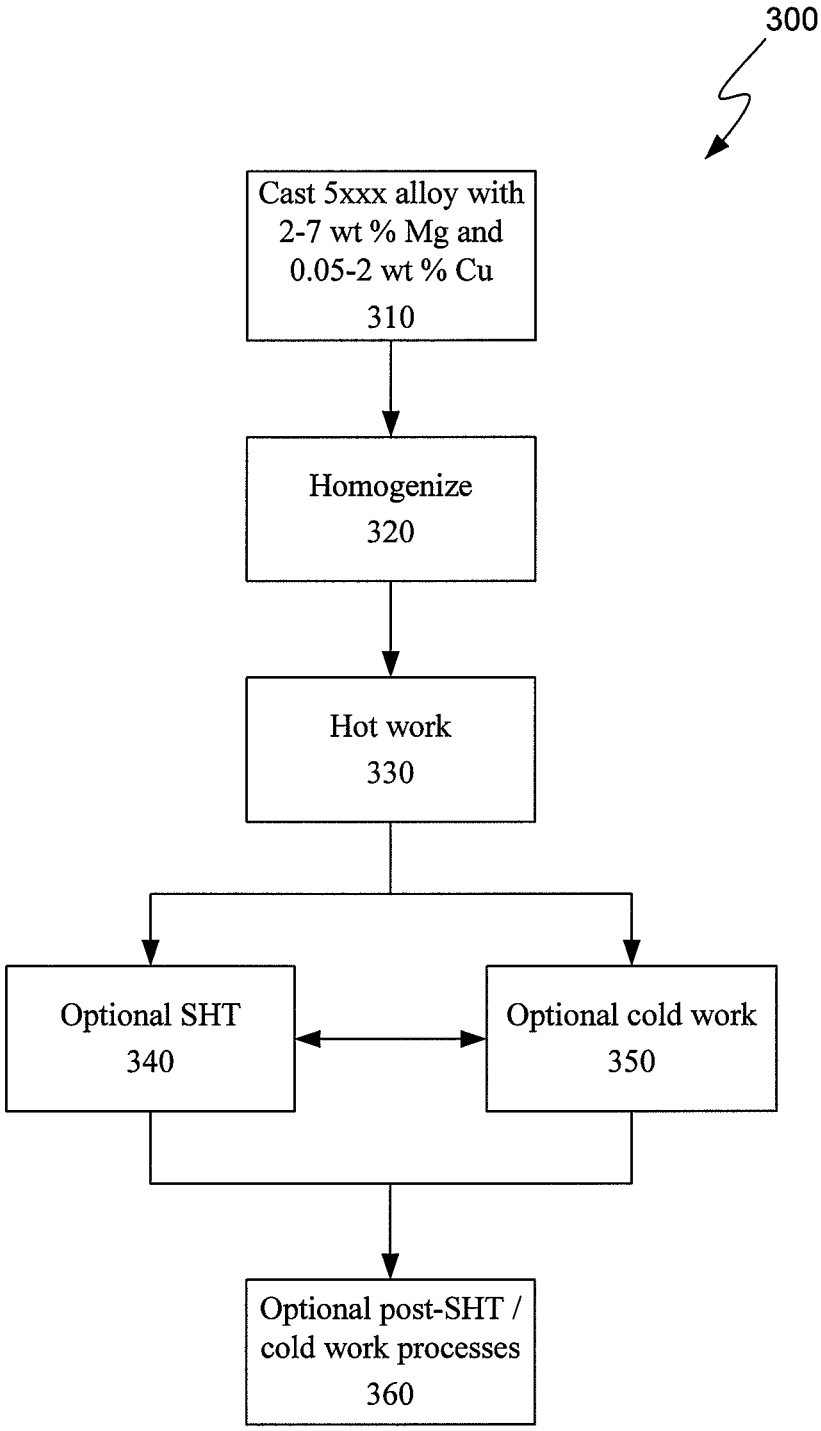
FIG. 3 is a flow chart illustrating one embodiment of a method for producing a new 5xxx aluminum alloy product.

Alloy 12, in the H131 and T3 tempers, is subjected to ballistics testing, the results of which are illustrated in FIGS. 1 and 2. With respect to FSP performance (FIG. 1), both tempers achieve improved ballistics performance, achieving about a 10% reduction in weight at similar V50 armor piercing performance relative to prior art alloy 5083 minimums, or, stated differently, an improved V50 performance at an equivalent areal density relative to prior art alloy minimums. With respect to AP performance (FIG. 2), both alloys achieve improved ballistics performance, achieving about a 13% reduction in weight at similar V50 armor piercing performance relative to prior art alloy 5083 minimums, or, stated differently, an improved V50 performance at an equivalent areal density relative to prior art alloy minimums.

Example 4

Eleven book mold castings are cast in a manner similar to that described in Example 1. The amount of Mg, Cu and Mn of each casting are listed in Table 8, below (all values in weight percent), the balance being aluminum, additives and unavoidable impurities. The casting are then homogenized, scalped, and hot rolled to an intermediate gauge of about 8 mm. Each casting is then solution heat treated for about 2 hours at a temperature of about 482° C. (900° F.), after which it is cold water quenched. After a natural aging period of about 4 days, each casting is reduced about 30% in gauge by cold rolling, achieving a final gauge of about 5.8 mm. The castings are then stress relieved by stretching about 1%. The experimental alloy products are subjected to mechanical property testing in accordance with ASTM B557 and E8, the results of which are provided in Table 8, below.

?TABLE 8

| Composition and Mechanical Properties of Experimental 5xxx Alloys | | | | | | |
|---|---|---|---|---|---|---|
| Ex. Alloy | Mg | Cu | Mn | UTS (ksi) | TYS (ksi) | Elong (%) |
| A | 4.92 | 0.00 | 0.52 | 50.1 | 43.3 | 21.8 |
| B | 4.7 | 0.05 | 0.48 | 51.7 | 47.0 | 17.7 |
| C | 4.85 | 0.10 | 0.59 | 51.6 | 46.5 | 17.4 |
| D | 4.86 | 0.15 | 0.52 | 52.8 | 47.7 | 17.0 |
| E | 4.88 | 0.20 | 0.5 | 53.4 | 48.5 | 17.3 |
| F | 4.92 | 0.26 | 0.54 | 53.2 | 48.1 | 16.1 |
| G | 4.95 | 0.43 | 0.54 | 55.4 | 50.5 | 13 |
| H | 2.49 | 0.11 | 0.56 | 34.6 | 32.6 | 20.9 |
| I | 2.93 | 0.10 | 0.57 | 38.1 | 35.7 | 19.7 |
| J | 6 | 0.10 | 0.53 | 58.1 | 51.8 | 14.5 |
| K | 5 | 0.11 | 0.54 | 52.6 | 47.2 | 17.1 |

All alloys contained optional additives of 0.11-0.14 wt. % Zr and 0.016-0.018 wt. % Ti, and less than 0.05 wt. % each of Fe and Si impurities. In addition, Alloy K contained about 0.22 wt. % Zn.

With respect to copper additions, from the baseline alloy, Alloy A, the new 5xxx aluminum alloys realize significant increases in strength with only 0.05 wt. % addition of copper, realizing about an 8.5% increase in tensile yield strength. All alloys containing from about 0.05 to about 0.50 wt. % copper realized an increase in strength over Alloy A, realizing any-where from about an 8.5% to about a 16.6% increase in tensile yield strength, as shown in Table 9, below.

TABLE 9

Effect of Copper on Mechanical Properties

| Ex. Alloy | Mg | Cu | Mn | TYS (ksi) | Increase over baseline |
|---|---|---|---|---|---|
| A | 4.92 | 0.00 | 0.52 | 43.3 | — |
| B | 4.7 | 0.05 | 0.48 | 47.0 | 8.55% |
| C | 4.85 | 0.10 | 0.59 | 46.5 | 7.39% |
| D | 4.86 | 0.15 | 0.52 | 47.7 | 10.16% |
| E | 4.88 | 0.20 | 0.5 | 48.5 | 12.01% |
| F | 4.92 | 0.26 | 0.54 | 48.1 | 11.09% |
| G | 4.95 | 0.43 | 0.54 | 50.5 | 16.63% |

With respect to the effect of zinc additions on strength, Alloy K contained about 0.22 wt. % zinc. Alloys B and C contain no zinc, but similar levels of Cu, Mg and Mn, and optional additives and impurities. Alloys B, C, and K realize similar tensile yield strength performance. This, in combination with the Example 1 results, illustrates that at least about 0.3 wt. % zinc should be included to increase the strength of alloys.

The experimental alloys are tested for corrosion resistance in accordance with ASTM G67. The corrosion results are provided in Tables 10a-10b below, in the as-fabricated and sensitized conditions, respectively. The corrosion results show that, in the as-fabricated condition, the intergranular corrosion resistance is comparable for all of the experimental alloys. In the "sensitized" condition the ASTM G67 results indicate that the intergranular corrosion resistance increases with increasing Cu content; corrosion resistance also increases with decreasing Mg content, as expected, but a concomitant decrease in strength is also realized.

TABLE 10a

Corrosion Properties of Experimental Alloys - As-Fabricated

| Ex. Alloy | Mg | Cu | Mm | EC (% IACS) | Mass Loss ($g/cm^2$) |
|---|---|---|---|---|---|
| A | 4.92 | 0.00 | 0.52 | 26.9 | 1.46 |
| B | 4.7 | 0.05 | 0.48 | 26.4 | 1.22 |
| C | 4.85 | 0.10 | 0.59 | 26.7 | 1.22 |
| D | 4.86 | 0.15 | 0.52 | 26.4 | 1.04 |
| E | 4.88 | 0.20 | 0.5 | 26.9 | 1.17 |
| F | 4.92 | 0.26 | 0.54 | 26.4 | 1.02 |
| G | 4.95 | 0.43 | 0.54 | 26.7 | 1.71 |
| H | 2.49 | 0.11 | 0.56 | 30.9 | 1.07 |
| I | 2.93 | 0.10 | 0.57 | 30.0 | 1.18 |
| J | 6 | 0.10 | 0.53 | 25.0 | 1.38 |
| K | 5 | 0.11 | 0.54 | 26.7 | 1.39 |

TABLE 10b

Corrosion Properties of Experimental Alloys - Sensitized

| Ex. Alloy | Mg | Cu | Mn | EC (% IACS) | Mass Loss ($g/cm^2$) |
|---|---|---|---|---|---|
| A | 4.92 | 0.00 | 0.52 | 27.0 | 57.8 |
| B | 4.7 | 0.05 | 0.48 | 26.9 | 53.5 |
| C | 4.85 | 0.10 | 0.59 | 27.2 | 47.5 |
| D | 4.86 | 0.15 | 0.52 | 26.7 | 45.9 |
| E | 4.88 | 0.20 | 0.5 | 26.7 | 41.2 |
| F | 4.92 | 0.26 | 0.54 | 26.7 | 39.0 |
| G | 4.95 | 0.43 | 0.54 | 27.0 | 29.5 |
| H | 2.49 | 0.11 | 0.56 | 31.2 | 1.15 |
| I | 2.93 | 0.10 | 0.57 | 30.1 | 2.07 |

TABLE 10b-continued

Corrosion Properties of Experimental Alloys - Sensitized

| Ex. Alloy | Mg | Cu | Mn | EC (% IACS) | Mass Loss ($g/cm^2$) |
|---|---|---|---|---|---|
| J | 6 | 0.10 | 0.53 | 25.4 | 75.5 |
| K | 5 | 0.11 | 0.54 | 27.0 | 58.2 |

While various embodiments of the new technology described herein have been described in detail, it is apparent that modifications and adaptations of those embodiments will occur to those skilled in the art. However, it is to be expressly understood that such modifications and adaptations are within the spirit and scope of the presently disclosed technology.

What is claimed is:

1. A 5xxx aluminum alloy consisting of:

from 4.0 wt. % to 5.5 wt. % Mg;

from 0.1 wt, % to 0.5 wt, % Cu;

from 0.3 wt. % to 0.8 wt. % Mn;

from 0.05 wt. % to 0.25 wt, % Zr;

up to 0.10 wt. % Ti, wherein the Ti may comprise at least one of $TiB_2$ and TiC;

up to 0.05 wt. % each of Ca, Sr and Bi;

up to 500 ppm of Be; and the balance being aluminum and unavoidable impurities, wherein the unavoidable impurities comprise Zn and Fe, and wherein the alloy includes not greater than 0.15 wt. % Zn and not greater than 0.15 wt. % Fe;

wherein the 5xxx aluminum alloy is in the form of an armor plate product;

wherein the armor plate product achieves at least 9% better V50 fragment simulation projectile (FSP) ballistics performance than a comparable 5083 aluminum alloy armor product at equivalent areal density; and wherein the armor plate product achieves at least 6% better V50 armor piercing (AP) ballistics performance than a comparable 5083 aluminum alloy armor product at equivalent areal density.

2. The 5xxx aluminum alloy of claim 1, wherein the 5xxx aluminum alloy includes at least 0.15 wt. % Cu.

3. The 5xxx aluminum alloy of claim 1, wherein the 5xxx aluminum alloy includes at least 0.20 wt. % Cu.

4. The 5xxx aluminum alloy of claim 1, wherein the 5xxx aluminum alloy includes at least 0.25 wt. % Cu.

5. The 5xxx aluminum alloy of claim 4, wherein the 5xxx aluminum alloy includes from 10 ppm to 80 ppm of at least one of Ca, Sr, and Bi.

6. The 5xxx aluminum alloy of claim 5, wherein the 5xxx aluminum alloy includes not greater than 20 ppm of Be.

7. The 5xxx aluminum alloy of claim 6, wherein the 5xxx aluminum alloy includes up to 0.03 wt. % Ti.

8. The 5xxx aluminum alloy of claim 1, wherein the armor plate product achieves at least 10% better V50 fragment simulation projectile (FSP) ballistics performance than a comparable 5083 aluminum alloy armor product at equivalent areal density.

9. The 5xxx aluminum alloy of claim 1, wherein the armor plate product achieves at least 11% better V50 fragment simulation projectile (FSP) ballistics performance than a comparable 5083 aluminum alloy armor product at equivalent areal density.

10. The 5xxx aluminum alloy of claim 1, wherein the armor plate product achieves at least 12% better V50 fragment simulation projectile (FSP) ballistics performance than a comparable 5083 aluminum alloy armor product at equivalent areal density.

11. The 5xxx aluminum alloy of claim 1, wherein the armor plate product achieves at least 13% better V50 fragment simulation projectile (FSP) ballistics performance than a comparable 5083 aluminum alloy armor product at equivalent areal density.

12. The 5xxx aluminum alloy of claim 1, wherein the armor plate product achieves at least 14% better V50 fragment simulation projectile (ESP) ballistics performance than a comparable 5083 aluminum alloy armor product at equivalent areal density.

13. The 5xxx aluminum alloy of claim 1, wherein the armor plate product achieves at least 7% better V50 armor piercing (AP) ballistics performance than a comparable 5083 aluminum alloy armor product at equivalent areal density.

14. The 5xxx aluminum alloy of claim 1, wherein the armor plate product achieves at least 8% better V50 armor piercing (AP) ballistics performance than a comparable 5083 aluminum alloy armor product at equivalent areal density.

15. The 5xxx aluminum alloy of claim 1, wherein the armor plate product achieves at least 9% better V50 armor piercing (AP) ballistics performance than a comparable 5083 aluminum alloy armor product at equivalent areal density.

16. The 5xxx aluminum alloy of claim 1, wherein the armor plate product achieves at least 10% better V50 armor piercing (AP) ballistics performance than a comparable 5083 aluminum alloy armor product at equivalent areal density.

17. The 5xxx aluminum alloy of claim 1, wherein the armor plate product achieves at least 11% better V50 armor piercing (AP) ballistics performance than a comparable 5083 aluminum alloy armor product at equivalent areal density.

18. The 5xxx aluminum alloy of claim 1, wherein the armor plate product achieves at least 12,% better V50 armor piercing (AP) ballistics performance than a comparable 5083 aluminum alloy armor product at equivalent areal density.

19. The 5xxx aluminum alloy of claim 1, wherein the armor plate product achieves at least 13% better V50 armor piercing (AP) ballistics performance than a comparable 5083 aluminum alloy armor product at equivalent areal density.

* * * * *